United States Patent [19]

Russell et al.

[11] 4,445,577

[45] May 1, 1984

[54] BULLDOZER BLADE

[75] Inventors: Dean E. Russell; Tom H. Russell, both of Eureka, Kans.

[73] Assignee: Russell & Sons Construction Co. Inc., Eureka, Kans.

[21] Appl. No.: 332,459

[22] Filed: Dec. 21, 1981

[51] Int. Cl.[3] ..... E02F 3/80

[52] U.S. Cl. ..... 172/701.3; 37/217

[58] Field of Search ..... 172/701.1, 701.2, 701.3, 172/815, 825; 37/276, 217

[56] References Cited

U.S. PATENT DOCUMENTS

| | | | |
|---|---|---|---|
| 2,219,159 | 10/1940 | Flynn | 172/701.1 |
| 2,485,407 | 10/1949 | Peterson | 172/701.3 |
| 2,674,817 | 4/1954 | Palmiter | 172/701.1 |
| 3,085,832 | 4/1963 | Guillemette | 37/276 |
| 3,424,251 | 1/1969 | Bouley | 172/815 |
| 3,604,517 | 9/1971 | Clifford | 172/825 |
| 3,974,882 | 8/1976 | Eftefield | 172/701.1 |

FOREIGN PATENT DOCUMENTS

| | | | |
|---|---|---|---|
| 30717 | 5/1960 | Finland | 172/701.3 |
| 141497 | 10/1960 | U.S.S.R. | 172/701.1 |

*Primary Examiner*—Richard J. Johnson

*Attorney, Agent, or Firm*—Schmidt, Johnson, Hovey & Williams

[57] ABSTRACT

A blade suitable for attachment to an earth-moving machine is provided that substantially increases the size of the load that can be carried by the machine. The blade includes a pair of elongated, juxtaposed blade portions joined together at a common centerline to cooperatively define a chevron-shaped load bearing area. Each of the blade portions has a generally concave, earth-engaging forward face, and the before-mentioned centerline is recessed in relation to the outermost lateral edges of the blade portions. A generally triangular plate is secured to and depends from the pair of blade portions, and a detachable earth-cutting element is mounted on the lowermost generally horizontal edge of the plate. The unique and novel structure of the blade draws the earth cut by the cutting edge rearwardly and upwardly towards the cutter of the blade, and then rolls the earth forwardly of the blade, thereby decreasing the frictional resistance of the load and increasing the load which can be carried by the earth-moving machine.

3 Claims, 7 Drawing Figures

Fig. 1.
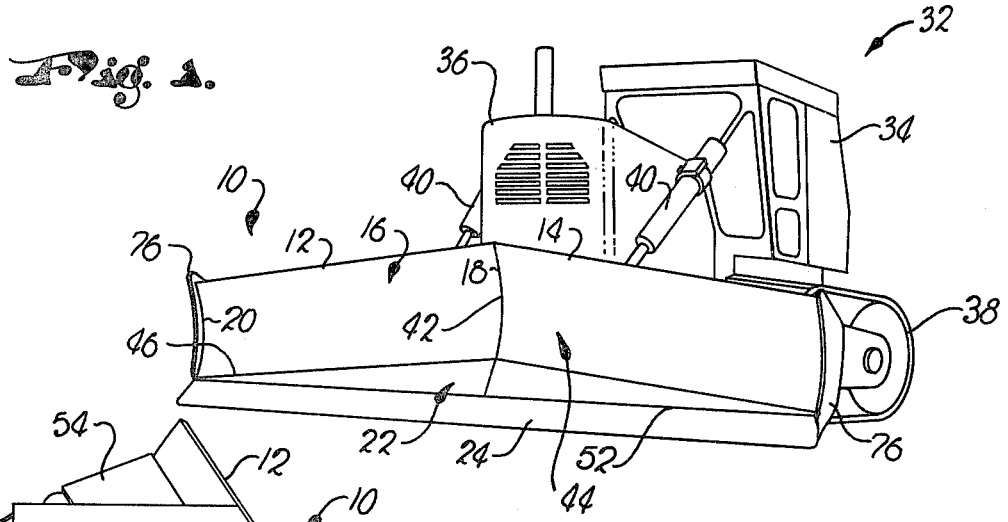
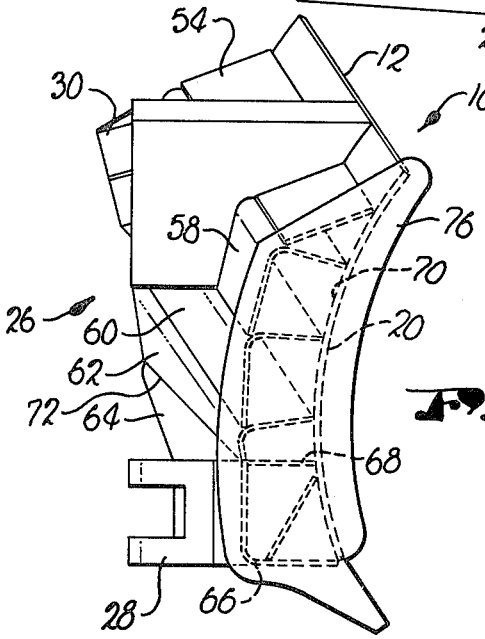
Fig. 2.
Fig. 3.
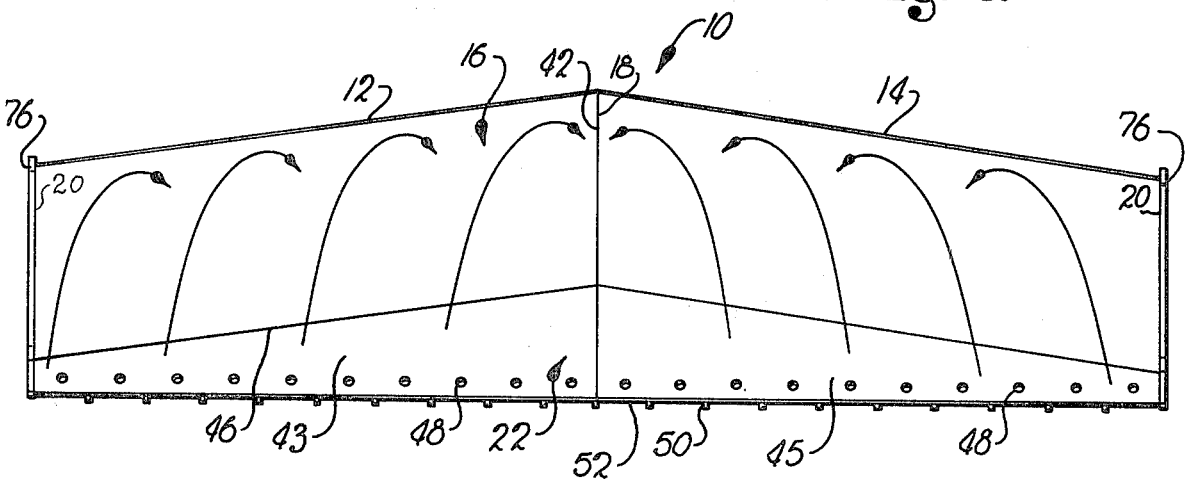

BULLDOZER BLADE

BACKGROUND OF THE INVENTION

1. Field of the Invention

This invention relates to a bulldozer blade of simple yet highly effective construction which substantially increases the size of the load that can be carried by an earth-moving machine. More particularly, it is concerned with a bulldozer blade having a pair of elongated, juxtaposed, cross-sectionally arcuate and interconnected blade portions, the longitudinal axes of which are oriented obliquely to the horizontal, a generally triangular plate secured to and depending from the blade portions, a detachable cutting element mounted on the triangular plate, a blade reinforcing structure, and mounting brackets suitable for attaching the bulldozer blade to an earth-moving machine.

2. Description of the Prior Art

The size of a load that can be moved by an earth-moving machine is one measure of the machine's effectiveness. A conventional means for increasing the load-bearing capacity of an earth-moving machine is to increase the size of the earth-engaging blade, and to correspondingly increase the horsepower available in the earth-moving machine. The requirements of increasing the horsepower of the earth-moving machine is undesirable because it makes existing earth-moving equipment obsolete before its useful life has expired, and because the requirement for higher horsepower engines is inherently inefficient from an energy standpoint. An earth-engaging blade that would increase the size of a load that could be carried by an earth-moving machine without increasing the horsepower requirements of the machine would be a decided advantage.

SUMMARY OF THE INVENTION

The problems outlined above are in large measure solved by the bulldozer blade of the present invention. That is to say, the blade hereof is suitable for attachment to an earth-moving machine, and the blade substantially increases the size of the load that can be carried by the machine. The blade of the present invention broadly includes a pair of elongated, juxtaposed, cross-sectionally arcuate and interconnected blade portions, the longitudinal axes of which are oriented obliquely to the horizontal, a generally triangular plate secured to and depending from the blade portions, a detachable cutting element mounted on the triangular plate, a blade reinforcing structure, and brackets mounted on the reinforcing structure suitable for attaching the bulldozer blade to an earth-moving machine.

The blade portions each have a generally concave, earth-engaging forward face and an inner margin and an outer margin. The inner margins of the blade portions are proximal to one another and form a common centerline for the blades. The centerline is recessed in relation to the blade outer margins, and the blade portions cooperatively define a chevron-shaped load bearing area.

BRIEF DESCRIPTION OF THE DRAWINGS

FIG. 1 is a perspective view of an earth-moving machine with the bulldozer blade of the present invention mounted thereon;

FIG. 2 is a perspective view of the bulldozer blade of the present invention, phantom lines depicting the lateral edges of the blade reinforcing structure;

FIG. 3 is a front elevational view of the bulldozer blade of the present invention, depicted with the cutting element detached from the blade, arrows depicting the direction of travel of earth as it is moved by the blade;

DESCRIPTION OF THE PREFERRED EMBODIMENT

Figure 4:
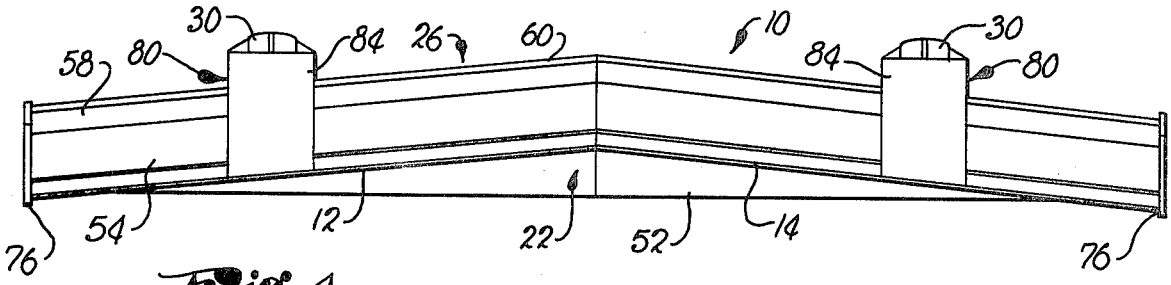
FIG. 4 is a plan view of the blade of the present invention.
Figure 5:
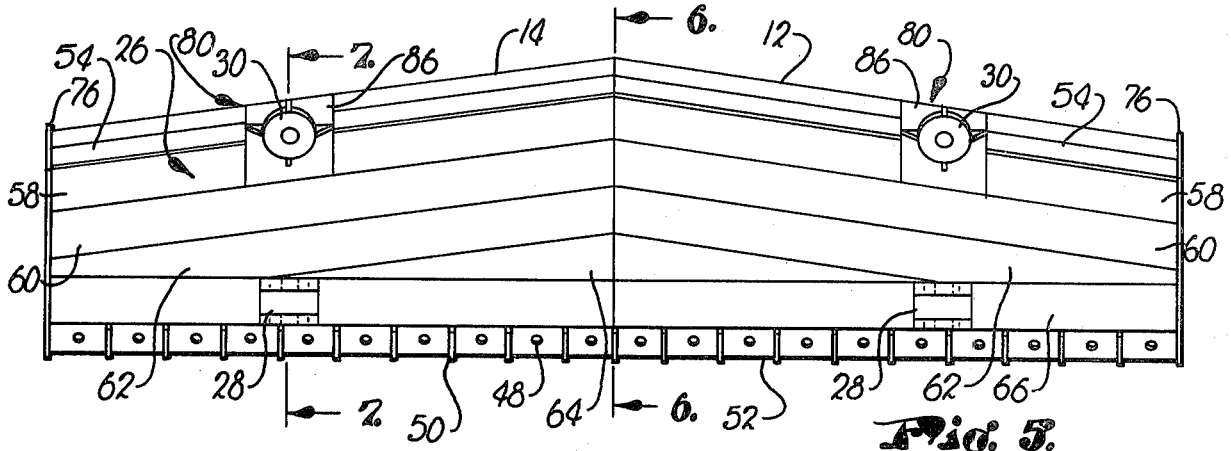
FIG. 5 is a rear elevational view of the blade of the present invention, depicted with the cutting edge detached.
Figure 6:
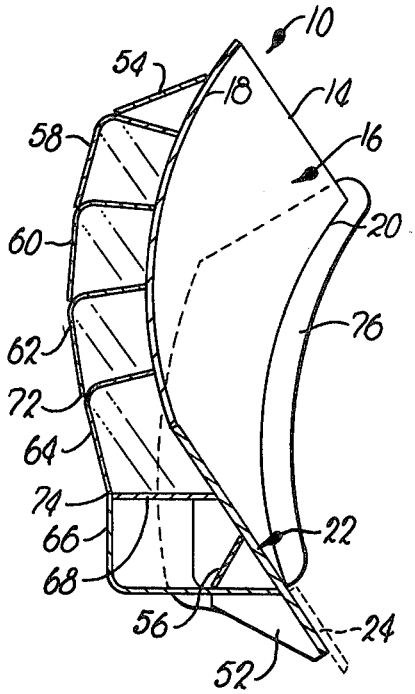
FIG. 6 is a cross-sectional view taken along the line 6—6 of FIG. 5, phantom lines depicting the cutting element and rearmost edges of one end plate.
Figure 7:
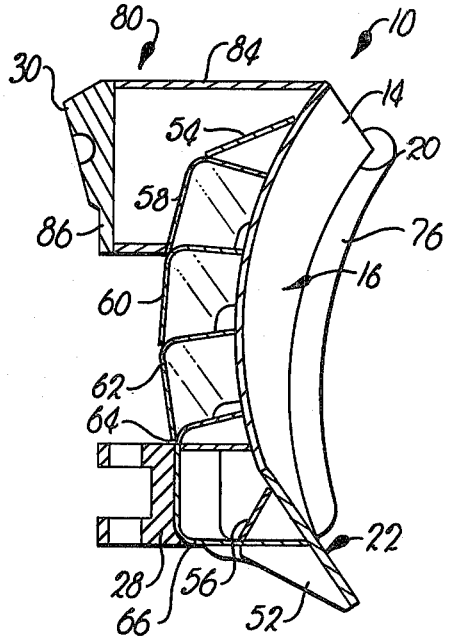
FIG. 7 is a cross-sectional view taken along the line 7—7 of FIG. 5.

Referring now to the drawings, an earth-engaging or bulldozer blade 10 broadly includes a pair of elongated, juxtaposed, interconnected blade portions 12, 14, each having a generally concave earth-engaging forward face 16 and inner and outer margins 18, 20, a generally triangular plate 22 secured to and depending from the blade portions 12, 14, a detachable cutting element 24, blade reinforcing structure 26, and a pair of clevises 28 and sockets 30. The blade 10 is depicted in conjunction with an earth-moving machine or bulldozer 32 having a cab 34, an engine compartment 36, a traction assembly 38 and blade supporting extensible members 40.

The inner margins 18 of blade portions 12, 14 are spaced rearwardly from the outer margins 20 and are joined together as by welding to form a common center line 42 recessed in relation to the outermost lateral edges or outer margins 20 of the blade portions 12, 14. The longitudinal axes of the blade portions 12, 14 are oriented obliquely to the horizontal and the portions 12, 14 define a chevron-shaped load-bearing area 44. The blade portions 12, 14 are cross-sectionally arcuate, and define arcs of generally uniform radii. The blade portions may advantageously be sectioned from a single cylinder of uniform radius.

The triangular plate 22 advantageously includes subplates 43, 45. The plate 22 is welded to the blade portions 12, 14 along seam 46. The plate includes bolt-receiving apertures as at 48 and reinforcing ridges as at 50 along its lowermost, generally horizontal edge 52. The cutting element 24 is secured to the horizontal edge 52 of the plate 22 by bolts (not shown).

The blade reinforcing structure 26 includes a pair of obliquely oriented top plates 54 and bottom plates 56, four pair of stacked, reinforcing angle irons 58, 60, 62, 64, a lowermost reinforcing angle
zontal support plate 68 extending from the uppermost edge of the lowermost angle iron 66 to the rearward facing surfaces 70 of the blade portions 12, 14. The support plates and angle irons are secured to each other and to the surfaces 70 by welding. The longitudinal axes of the four stacked angle irons 58, 60, 64, 64 are parallel with the longitudinal axes of the respective blade portions 12, 14 to which they are welded. It will be noted that, because the angle iron axes are parallel to the blade portion axes, the angle iron pairs 58, 60, 62, 64 are oriented obliquely to the horizontal, and the angle iron pairs 62, 64 are necessarily tapered along their lowermost horizontal edges 72, 74. A pair of vertically oriented end plates 76 are welded to the lateral edges 78 of reinforcing structure 26 and outer margins 20 of blade portions 12.

A pair of load-transmitting socket supports 80, each having a pair of sidewalls 82, a top wall 84, and a rear wall 80 are welded to the rearward facing surfaces 70 of blade portions 12, 14 and to the top plate pair 54 and angle iron pair 58 of the blade reinforcing structure. The sockets 30 are supported by the rear walls 86 of the socket supports 80. Four triangular flanges extend between each ball socket 30 and its associated socket support rear wall 86. Clevises 28 are connected to and extend rearwardly from the lowermost angle iron 66.

In operation, earth collected by the cutting element 24 is transmitted rearwardly over the triangular plate 22 and into the load-bearing area 44. The unique construction of the blade 10 causes the earth in the load-bearing area 44 of the blade 10 to travel rearwardly and upwardly towards the blade centerline 42. The earth collected in the load-bearing area 44 is then rolled forwardly of the blade 10 due to the arcuate nature of blade portions 12, 14, where it is again collected in the load-bearing area 44 and again moved rearwardly and upwardly and then rolled forwardly. The effective frictional resistance of the load is substantially decreased because a portion of the load is always being rolled forwardly of the blade 10. In actual operation, it has been not unusual to increase the load carrying capacity of a given earth-moving machine by upwards of fifty percent when a blade 10 in conjunction with the present invention is used therewith.

I claim:

1. A blade suitable for attachment to an earth-moving machine, said blade comprising:

a pair of cross-sectionally arcuate blade portions joined together to form a common centerline and cooperatively defining a chevron-shaped load-bearing area, each of said portions presenting a concave earth-engaging forward face, said centerline being recessed in relation to the outermost lateral edges of said arcuate portions, the height of said blade at said centerline being greater than its height at said outermost lateral edges; and a generally triangular plate secured to and depending from said load-bearing area, said plate including a lowermost generally horizontal edge.

2. A blade as in claim 1 including a detachable cutting element and mounting apparatus for mounting said cutting element on to said plate.

3. A blade as set forth in claim 1, the longitudinal axes of said blade portions being oriented obliquely to the horizontal.

* * * * *